US010063974B2

(12) United States Patent
Kon

(10) Patent No.: US 10,063,974 B2
(45) Date of Patent: Aug. 28, 2018

(54) SPEAKER ARRAY FOR REDUCING INDIVIDUAL DIFFERENCES IN VIRTUAL SOUND FIELD REPRODUCTION

(75) Inventor: Homare Kon, Tokyo (JP)

(73) Assignee: SONY CORPORATION, Tokyo (JP)

( * ) Notice: Subject to any disclaimer, the term of this patent is extended or adjusted under 35 U.S.C. 154(b) by 551 days.

(21) Appl. No.: 13/879,179

(22) PCT Filed: Oct. 14, 2011

(86) PCT No.: PCT/JP2011/073684

§ 371 (c)(1),
(2), (4) Date: Apr. 12, 2013

(87) PCT Pub. No.: WO2012/053446

PCT Pub. Date: Apr. 26, 2012

(65) Prior Publication Data

US 2013/0216074 A1 Aug. 22, 2013

(30) Foreign Application Priority Data

Oct. 22, 2010 (JP) ..... 2010-238036

(51) Int. Cl.

| | |
|---|---|
| ***H04R 5/02*** | (2006.01) |
| ***H04R 5/033*** | (2006.01) |
| ***H04R 1/40*** | (2006.01) |
| ***H04R 1/10*** | (2006.01) |
| ***H04S 7/00*** | (2006.01) |

(52) U.S. Cl.

CPC ..... *H04R 5/02* (2013.01); *H04R 5/033* (2013.01); *H04R 1/1008* (2013.01); *H04R 1/403* (2013.01); *H04S 7/00* (2013.01); *H04S 2420/13* (2013.01)

(58) Field of Classification Search

CPC ..... H04R 5/02; H04R 5/033; H04R 1/1008; H04R 1/403; H04S 7/00; H04S 2420/13

See application file for complete search history.

(56) References Cited

U.S. PATENT DOCUMENTS

| | | | | |
|---|---|---|---|---|
| 6,038,330 | A * | 3/2000 | Meucci, Jr. | 381/371 |
| 2006/0204016 | A1* | 9/2006 | Pham et al. | 381/74 |
| 2006/0269070 | A1* | 11/2006 | Miura | H04R 5/04 381/17 |
| 2009/0296954 | A1* | 12/2009 | Hooley | F41H 13/0081 381/80 |

* cited by examiner

*Primary Examiner* — Ping Lee
(74) *Attorney, Agent, or Firm* — Chip Law Group

(57) ABSTRACT

[object] To provide a headphone device in which the influence of individual differences in virtual sound field reproduction is less likely to occur and which may listen external sounds naturally,

[solution] A left-side headphone body and a right-side headphone body include speaker arrays which are formed of a plurality of speaker units which are arranged to surround auricles, respectively. The speaker array of the headphone body reproduces a sound field inside a closed curved surface in the vicinity of the auricle using wave field synthesis, and since reverberation or a diffraction effect occurs in the ear of each individual, the influence caused by individual differences is less likely to occur. In addition, the speaker array has the plurality of the speaker units arranged to surround the auricle and is not of a shape that blocks the ear of the listener, and then the external sound can be heard naturally.

17 Claims, 4 Drawing Sheets

SPEAKER ARRAY FOR REDUCING INDIVIDUAL DIFFERENCES IN VIRTUAL SOUND FIELD REPRODUCTION

TECHNICAL FIELD

The present invention relates to a headphone device and specifically, a headphone device including a speaker array which has a plurality of speaker units.

BACKGROUND ART

Conventional studies have been carried out related to sound field reproduction method. Regarding speaker reproduction, surround reproduction such as 5.1 ch. and 7.1 ch. is generally proposed and is commercialized. An advantage of this technique is to use speakers called rear surround sound speakers, as well as front speakers and in combination they are capable of reproducing rear and environmental sounds.

However, a problem arises during the surround sound reproduction to find the best ideal sound field point for listening in a service area of the installation center, of which is limited. In addition, in surround sound reproduction, there is a problem that it is difficult, to arrange the speakers in a rear position in an actual home.

As a measure to solve the problem concerning the speaker arrangement, there is a front surround speaker using a transoral technique. In the front surround speaker, virtual surround sound can be enjoyed by using only the front speaker and using a head-related transfer function. The advantage of the technique is that the speaker can be easily installed and the system is simple. On the other hand, there is a problem that individual variations in the effect may occur because the head-related transfer function is used. In addition, also in the technique, there is a problem concerning the listening position that the ideal position for the reproduction is limited.

As a measure to solve the problem concerning the listening position, there is a sound field reproduction technique using wave field synthesis (see, NPL 1). This is such a technique that the sound field inside a closed curved surface can be completely controlled if a speaker array is configured, and a sound pressure having the closed curved surface shape which does not include a sound source and a particle velocity in the normal direction can be completely controlled. When using the sound field reproduction technique which uses wave field synthesis, the sound field inside the closed curved surface is completely reproduced and the degree of freedom of the listening position is also increased.

For example, in PTL 1, a three-dimensional sound field reproduction device is disclosed in which a plurality of speakers of the speaker array cover the entire head of the listener and a high level of realism can be reproduced. However, in the three-dimensional sound field reproduction device, since the plurality of speakers are used and to configure the array is needed, there is a problem that the scale becomes large. In addition, in a case of using the speaker array, there is a problem in that the frequency band to be reproduced is limited by the distance between the speakers due to a problem of spatial aliasing.

On the other hand, in the field of headphone reproduction, there is a virtual surround sound using the head-related transfer function. When using the virtual surround, it is possible to ideally enjoy sound field with a handy headphone device and the problem concerning the listening position does not occur.

CITATION LIST

Patent Literature

PTL 1: Japanese Unexamined Patent Application Publication No. 2008-118559

Non Patent Literature

NPL 1: "Study on Three-Dimensional Virtual Reality based on Kirchhoff's Integral. Equation", Waseda University, Advance Research Institute for Science and Engineering, Acoustic Laboratory, Yoshio YAMAZAKI, [online], April, 1997, (search Oct. 1, 2010], Internet <URL: http: www.acoust.rise.waseda.ac.jp/publications/happyou/1997-h9.html>

SUMMARY OF INVENTION

Technical Problem

However, as described above, in virtual surround sound using the head-related transfer function in the field of the headphone reproduction, since the sound pressure in the vicinity of an entrance of the external auditory meatus is duplicated as "a point", there is a problem that influence of the individual auricle cannot be considered and an ideal effect cannot be obtained depending on an individual. In addition, generally, since the headphone has a shape blocking the ear, there is a problem that external sound cannot be heard even though a feeling of being out of the head may be obtained with virtual surround sound.

An object of the present invention is to provide a headphone device in which the influence of individual differences in virtual sound field reproduction is less likely to occur and which is capable of listening to the external sound naturally.

Solution to Problem

The concept of the present invention is a headphone device including:

a speaker array formed of a plurality of speaker units arranged to surround an auricle, wherein the speaker array reproduces a sound field inside a closed curved surface in the vicinity of the auricle using a wave field synthesis.

In the present invention, the speaker array is included. The speaker array formed of the plurality of speaker units arranged to surround the auricle. Then, the sound field inside the closed curved surface in the vicinity of the auricle is reproduced by the speaker array using the wave field synthesis. In this case, a sound pressure signal as a driving signal for causing the sound emitted at each position of speaker units is supplied to the plurality of speaker units of the speaker array so as to reproduce the sound field inside the closed curved surface in the vicinity of the auricle.

As described above, in the present invention, the sound field inside the closed curved surface in the vicinity of the auricle is reproduced by the speaker array using the wave field synthesis, and since reverberation or a diffraction effect occurs in the ear of an individual, the influence caused by individual differences is less likely to occur. In addition, in the present invention, the speaker array is formed of the plurality of the speaker units arranged to surround the auricle and is not of a shape that blocks the ear of the listener, and then the external sound can be heard naturally.

In the present invention, for example, the plurality of speaker units of the speaker array may be arranged to be inclined inwardly towards the closed curved surface. Accordingly, a propagation velocity of the particles in all up and down, and left and right directions can be reproduced satisfactorily inside the closed curved surface. For example, the headphone device may further include a donut-shaped ear pad having an opening portion in which the auricle may be inserted, and the plurality of speaker units of the speaker array may be arranged along a circular end portion which is opposite to an abutting side of a listener of the ear pad.

Further, in the present invention, for example, a distance Δd [m] of the plurality of the speaker units of the speaker array may satisfy a formula of $\Delta d < c/(2 \cdot fmax)$, when a reproduction maximum frequency is fmax [Hz] and a sound velocity is c [m/s]. Accordingly, a frequency band up to the reproduction maximum frequency, fmax [Hz] can be reproduced.

Advantageous Effects of Invention

According to the present invention, the influence of individual differences in the virtual sound field reproduction is less likely to occur and the external sound may be heard naturally. In other words, since the sound field inside the closed curved surface in the vicinity of the auricle is reproduced by the speaker array using the wave field synthesis, and reverberation or a diffraction effect occurs in the ear of an individual, the influence caused by individual differences is less likely to occur. In addition, the speaker array has the plurality of the speaker units arranged to surround the auricle and is not of a shape that blocks the ear of the listener, and then the external sound can be heard naturally.

DESCRIPTION OF EMBODIMENTS

Hereinafter, a mode (referred to as "an embodiment" below) for carrying out the present invention will be described. In addition, the description will be made in the following order.

1. Embodiment
2. Modification Example

<1. Embodiment>

[Configuration Example of Headphone Device]

Figure 1:
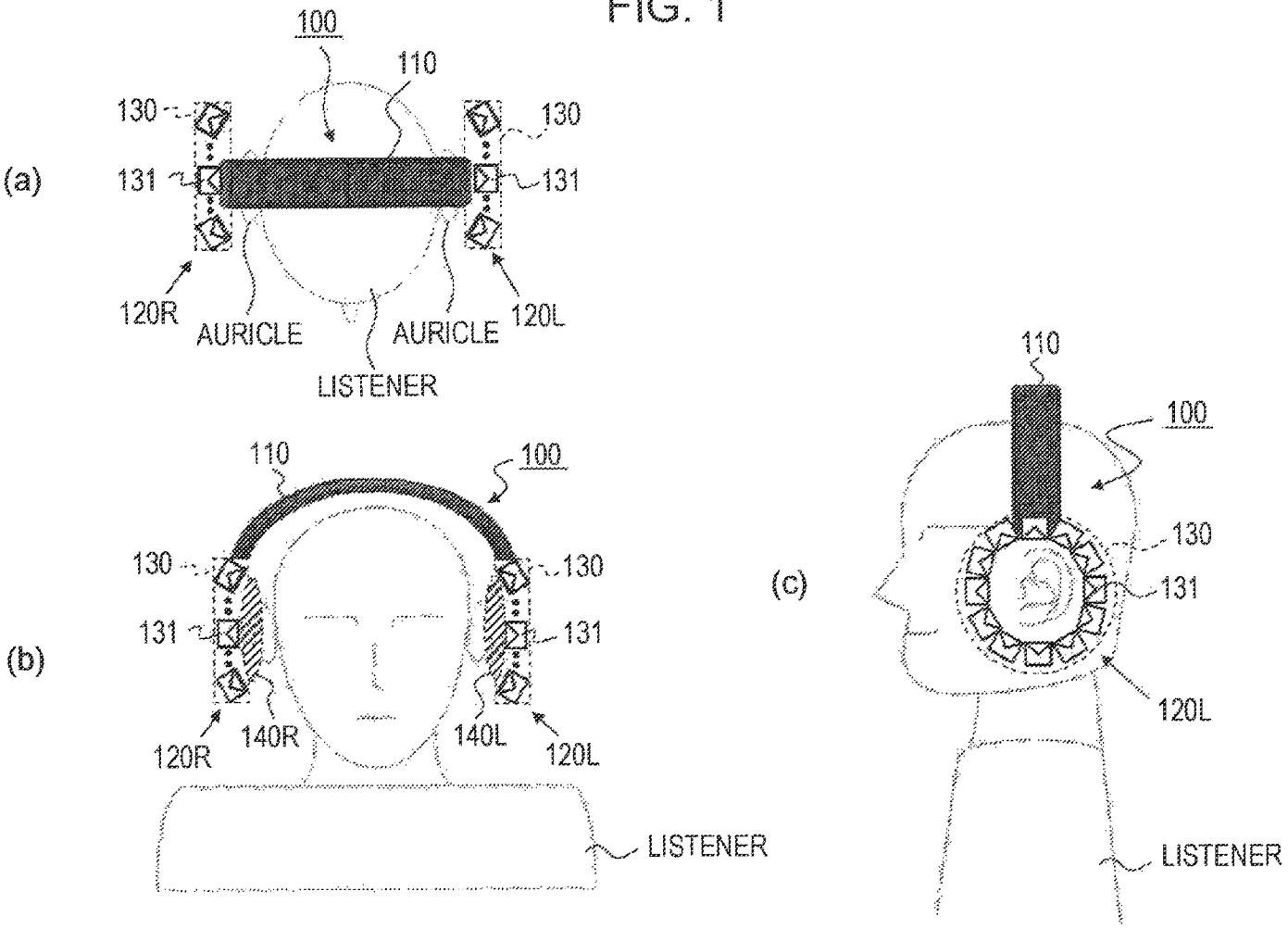
FIG. 1 is a view illustrating a configuration example of a headphone device as an embodiment of the present invention.

FIGS. 1(*a*) to (*c*) illustrate a configuration example of a headphone device 100 as the embodiment. FIG. 1(*a*) is a top view, FIG. 1(*b*) is a front view and FIG. 1(*c*) is a side view thereof. The headphone device 100 is configured such that a left-side headphone body 120L and a right-side headphone body 120R are connected to front end portions of the left and right of a head band 110, respectively.

The left-side headphone body 120L has a speaker array 130. The speaker array 130 is formed of a plurality of speaker units 131 which are arranged to surround the auricle (left-side) of a listener. The speaker array 130 included in the left-side headphone body 120L reproduces a sound field inside a closed curved surface 140L in the vicinity the auricle (left-side) illustrated in FIG. 1(*b*) using a wave field synthesis. A sound pressure signal as a driving signal for causing the sound to be emitted at each position of speaker units 131 is supplied to a plurality of speaker units 131 of the speaker array 130 included in the left-side headphone body 120L so that the sound field inside the closed curved surface 140L can be reproduced.

The right-side headphone body 120R also has the speaker array 130. The speaker array 130 is formed of a plurality of the speaker units 131 which are arranged to surround the auricle (right-side) of a listener. The speaker array 130 included in the right-side headphone body 120R reproduces a sound field inside a closed curved surface 140R in the vicinity of the auricle (right-side) illustrated in FIG. 1(*b*) using the wave field synthesis. The sound pressure signal as the driving signal for causing the sound to be emitted at each position of speaker units 131 is supplied to a plurality of speaker units 131 of the speaker array 130 included in the right-side headphone body 120R so that the sound field inside the closed curved surface 140R can be reproduced.

In addition, with respect to the wave field synthesis, a detailed description thereof will be omitted, however, for example, there is a method or the like in which the Kirchhoff's integral formula is used as indicated in the "Study on Three-Dimensional. Virtual Reality based on Kirchhoff's Integral Equation", Yoshio YAMAZAKI. In the method, the Sound field inside a closed curved surface S is reproduced by discretizing the closed curved surface S at N points and by reproducing a sound pressure P (rj) and a particle velocity un (rj) at the N points on the closed curved surface S. In the embodiment, the sound pressure signal supplied to each of the speaker units 131 of the speaker array 130 included in the headphone bodies 120L and 120R is generated, based on the wave field synthesis described above.

Figure 2:
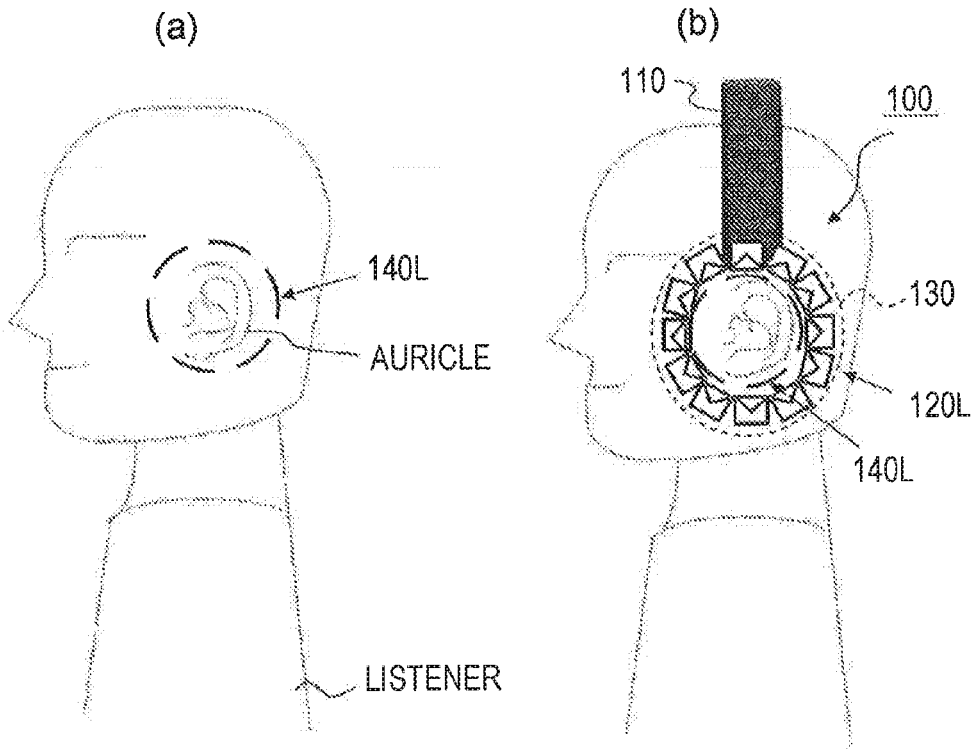
FIG. 2 is a view illustrating an example of a closed curved surface in which a sound field is reproduced by a speaker array included in a headphone body.

FIG. 2(*a*) illustrates an example of the closed curved surface 140L in which the sound field is reproduced by the speaker array 130 included in the left-side headphone body 120L. The closed curved surface 140L is a narrow region having a diameter of 8 to 10 cm around the external auditory meatus when viewed from the side head portion of the human (the listener). FIG. 2(*b*) illustrates a positional relationship between the left-side headphone body 120L and the closed curved surface 140L in a case where the headphone 100 is mounted. In addition, even though detailed description is omitted, similarly) the closed curved surface 140R in which the sound field is reproduced by the speaker array 130 included in the right-side headphone body 120R is a narrow region having a diameter of 8 to 10 cm around the external auditory meatus.

Figure 3:
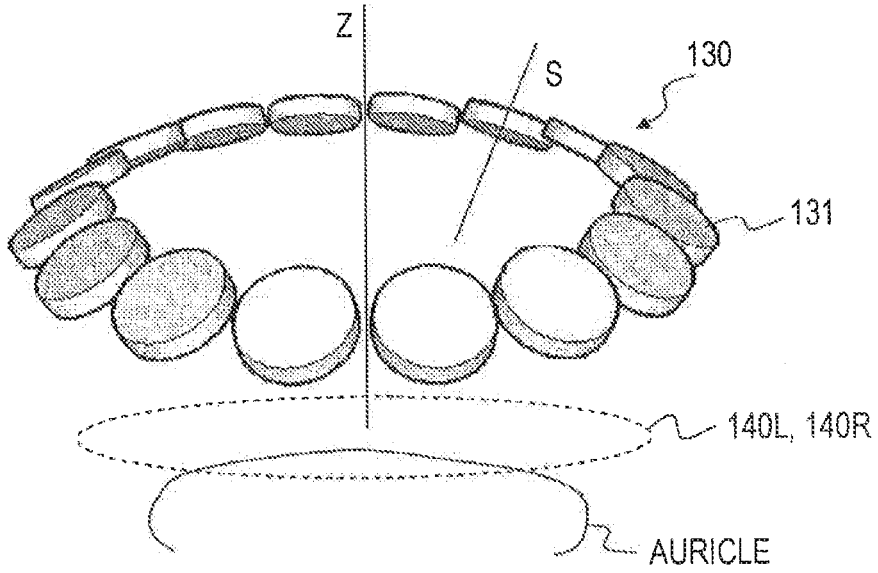
FIG. 3 is a view for explaining that a plurality of speaker units of the speaker array included in the headphone body arranged to be inclined inwardly towards the closed curved surface in which the sound field is reproduced.

As illustrated in FIG. 3, the plurality of speaker units 131 of the speaker array 130 included in the headphone bodies 120L and 120R are arranged to be inclined inwardly towards the closed curved surfaces 140L and 140R in which the sound field is reproduced. In other words, a central axis S of each speaker unit 131 is inclined towards a central axis Z of the speaker array 130. As described above, since the plurality of the speaker units 131 of the speaker array 130 are arranged to be inclined, a propagation velocity of the particles in all directions of up and down, and left and right can be reproduced satisfactorily inside the closed curved surfaces 140L and 140R.

Figure 4:
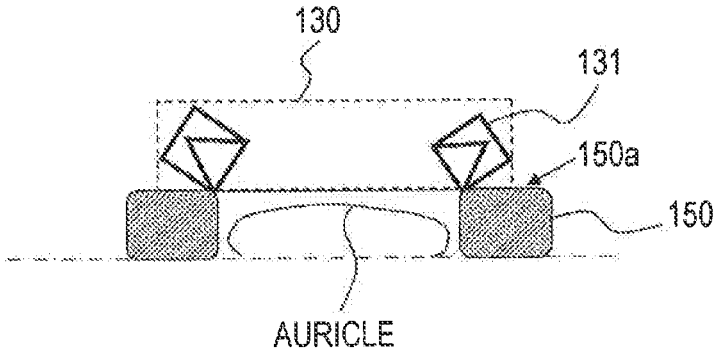
FIG. 4 is a view for explaining that the plurality of the speaker units of the speaker array are arranged along a circular end portion of an ear pad which is opposite to an abutting side of a listener.

In FIG. 1 described above, even though the illustration is omitted, the headphone bodies 120L and 120R include donut-shaped ear pads 150 having opening portions in which the auricle can be inserted, respectively. As illustrated in FIG. 4, the plurality of the speaker units 131 of the speaker array 130 described above are arranged along a circular end portion 150*a* of the ear pad 150, which is opposite to an abutting side of the listener.

Figure 5:
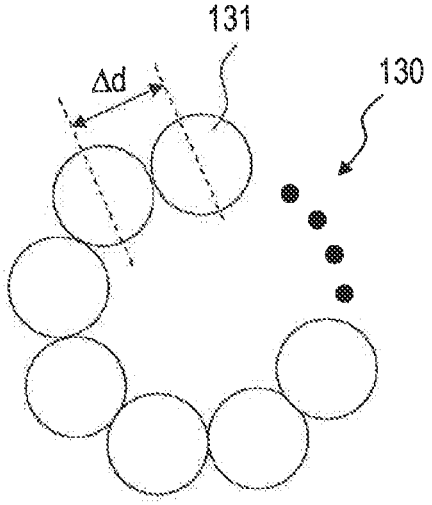
FIG. 5 is a view for explaining an arrangement distance of the plurality of the speaker units of the speaker array included in the headphone body.

As illustrated in FIG. 5, the plurality of the speaker units 131 of the speaker array 130 included in the headphone bodies 120L and 120R are arranged having a distance Δd [m]. The distance Δd [m] satisfies the following formula (1), when a reproduction maximum frequency is fmax [Hz]. In this regard, c is a sound velocity (approximately, 340 m/s). Accordingly, a frequency band up to the reproduction maximum frequency fmax [Hz] can be reproduced.

$$\Delta d < c/(2 \cdot f\mathrm{max}) \quad (1)$$

In general, the wave field synthesis system has a problem of spatial aliasing. The aliasing occurs at a frequency of a value that divides the sound velocity by twice of the distance and a reproducible boundary frequency is determined, based on the concept of spatial sampling. For example, when the speaker units are arranged in a distance of 5 cm, appropriately 3.4 kHz is the frequency of the spatial aliasing. This is an extremely low frequency compared to 20 kHz that is an audible band of a human. The spatial aliasing frequency falias [Hz] is indicated as the following formula (2), $$f\mathrm{alias} = c/(2 \cdot \Delta d) \quad (2)$$

The upper limit of the frequency rises when narrowing the distance thereof, which means that the sound pressure emitted from the speaker unit 131 is reduced, in addition, there is a trade-off relationship between the spatial aliasing and the sound pressure, and the sound field is difficult to reproduce in a large room. However, in the headphone device 100, since the speaker array 130 is in the vicinity of the auricle, a sufficient sound pressure can be presented to the listener even though the speaker unit 131 is small. For example, when using a super small-sized speaker unit of 8 mm, since Δd=0.008 m, the spatial aliasing frequency falias is 20 kHz or more and a sufficient sound field can be reproduced, by the formula (2).

Figure 6:
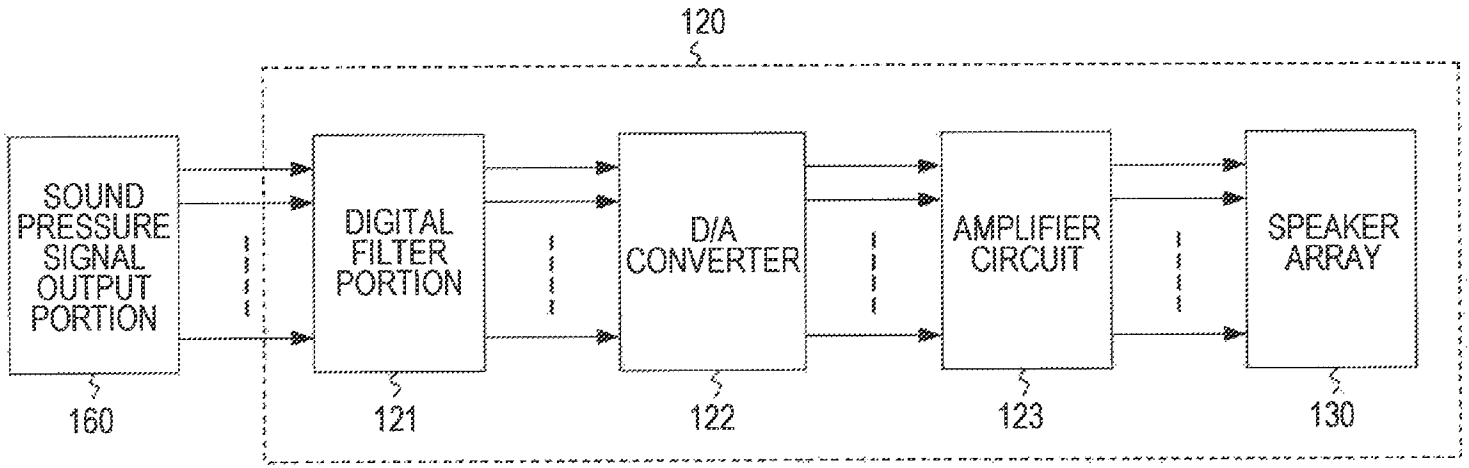
FIG. 6 is a block diagram illustrating a configuration example of a circuit which supplies a sound pressure signal to each speaker unit of the speaker array included in the headphone body.

FIG. 6 illustrates a configuration example of a circuit of the headphone body 120 (120L and 120R). The sound pressure signal corresponding to each of the speaker units 131 of the speaker array 130 is supplied from a sound pressure signal output portion 160 to the headphone body 120. As described above, the sound pressure signal is generated, based on wave field synthesis. For example, the sound pressure signal can be obtained by collecting the sound with a microphone which is arranged at a position of each of the speaker units. In addition, for example, the sound pressure signal can be obtained by carrying out a conversion process in a multi-channel signal such as 5.1 ch, and 7.1 ch.

The headphone body 120 has a digital filter portion 121, a D/A converter 122 and an amplifier circuit 123 as well as the speaker array 130. The sound pressure signal corresponding to each of speaker units 131 from the sound pressure signal output portion 160 is supplied to the speaker array 130 via the D/A converter 122 and the amplifier circuit 123 after the filter process is performed in the digital filter portion 121.

For example, the filter process in the digital filter portion 121 is a filter process for the control of the region. In this case, the sound emitted from each of the speaker units 131 of the speaker array 130 is the sound in a position slightly more inside than the position of the speaker unit 131 and is less likely to receive the influence of the spatial aliasing. In addition, for example, the filter process in the digital filter portion 121 is a filter process for correcting characteristics of each of the speaker units 131.

As described above, in the headphone device 100 illustrated in FIG. 1, the sound field inside the closed curved surfaces 140L and 140R in the vicinity of the auricle is reproduced by the speaker array 130 included in the headphone bodies 120L and 120R using the wave field synthesis. Accordingly, since reverberation or a diffraction effect occurs in the ear of an individual, the influence caused by individual differences is less likely to occur in the virtual sound field reproduction. In other words, the individual differences can be eliminated with a simple system of the headphone type compared to the speaker reproduction.

In addition, in the headphone device 100 illustrated in FIG. 1, the speaker array 130 included in the headphone bodies 120L and 120R has the plurality of the speaker units 131 which are arranged to surround the auricle. Accordingly, the speaker array 130 is not of a shape that blocks the ear of the listener and the external sound can be heard naturally. Accordingly, an effect combining the virtual sound field and the sound field of the real world, which is not possible in the headphone device of the related art, can also be present and natural conversation between two persons is also possible while the headphone device is worn.

<2. Modification Example>

In addition, the above embodiment is illustrated in such a manner that the plurality of the speaker units 131 are arranged in a circle in the speaker array 130 included in the headphone bodies 120L and 120R. However, the plurality of speaker units 131 may not be arranged in a circle and it may be arranged in an ellipse, in a square or in other shapes. In a word, speaker units may be arranged to surround the auricle. In addition, the above embodiment is illustrated in such a manner that the plurality of the speaker units 131 are arranged in a single circle in the speaker array 130 included in the headphone bodies 120L and 120R, however, a configuration which is arranged in double circles or triple circles may be considered.

REFERENCE SIGNS LIST

100 headphone device
110 head band
120 headphone body
120L left-side headphone body
120R right-side headphone body
121 digital filter portion
122 D/A converter
123 amplifier circuit
130 speaker array
131 speaker unit
140L, 140R closed curved surface
150 ear pad
150*a* circular end portion
160 sound pressure signal output portion

The invention claimed is:

1. A mounting type device to be mounted on a listener's head, comprising:

a speaker array comprising a plurality of speaker units circularly arranged to surround a listener's auricle, wherein the speaker array is configured to reproduce a sound field inside a closed curved surface based on a wave field synthesis, wherein the plurality of speaker units of the speaker array are arranged along and on an edge of a circular end portion which is opposite to an abutting side of a listener's ear pad and the plurality of speaker units are inclined inwardly towards the closed curved surface, and wherein the closed curved surface is a region around the listener's auricle, and wherein the closed curved surface is located between a body of the mounting type device and the listener's auricle.

2. The mounting type device according to claim 1, wherein the closed curved surface is in a normal direction with respect to a surface of the listener's auricle.

3. The mounting type device according to claim 1, wherein the plurality of speaker units surround a peripheral edge of the closed curved surface, and wherein the closed curved surface is a reproduction surface of the sound field.

4. The mounting type device according to claim 1, wherein the plurality of speaker units are configured to reproduce a propagation velocity of particles in directions of up and down, and left and right.

5. The mounting type device according to claim 1, wherein:

the listener's ear pad has an opening portion, and the listener's auricle is insertable in the opening portion of the listener's ear pad.

6. The mounting type device according to claim 5, wherein the listener's ear pad is donut-shaped having the opening portion in which the listener's auricle is inserted.

7. The mounting type device according to claim 1, wherein the plurality of speaker units are arranged having a distance Δd [m] in which the plurality of speaker units are further configured to reproduce a frequency band up to a reproduction maximum frequency where influence of spatial aliasing is absent.

8. The mounting type device according to claim 7, wherein the distance Δd [m] of the plurality of speaker units satisfies following formula, wherein the reproduction maximum frequency is fmax [Hz] and sound velocity is c [m/s], $$\Delta d < c/(2 \cdot f\max).$$

9. The mounting type device according to claim 1, wherein the closed curved surface is a region having a diameter of 8 to 10 cm around an external auditory meatus based on a view from a side head portion.

10. The mounting type device according to claim 1, wherein the plurality of speaker units are further configured to be driven by a sound pressure signal to emit a sound in a position corresponding to an arrangement position of each of the plurality of speaker units so that the plurality of speaker units are further configured to reproduce sound field inside the closed curved surface.

11. The mounting type device according to claim 10, wherein the position corresponding to the arrangement position is prevented to receive influence of spatial aliasing.

12. The mounting type device according to claim 10, wherein the position corresponding to the arrangement position is in an inner side from the arrangement position of each of the plurality of speaker units.

13. A method, comprising:

in a mounting type device to be mounted on a listener's head, the mounting type device comprising a speaker array, wherein the speaker array comprises a plurality of speaker units circularly arranged to surround a listener's auricle:

supplying a corresponding sound pressure signal to each of the speaker units of the plurality of speaker units; and reproducing a sound field inside a closed curved surface based on a wave field synthesis, wherein the plurality of speaker units of the speaker array are arranged along and on an edge of a circular end portion which is opposite to an abutting side of a listener's ear pad and the plurality of speaker units are inclined inwardly towards the closed curved surface, and wherein the closed curved surface, is a region around the listener's auricle, located between a body of the mounting type device and the listener's auricle.

14. A sound pressure signal supplying device, comprising:

a speaker array comprising a plurality of speaker units to be mounted on a listener's head and circularly arranged to surround a listener's auricle;

a sound pressure signal obtaining portion configured to obtain a plurality of sound pressure signals corresponding to the plurality of speaker units arranged to surround the listener's auricle;

a sound pressure signal supply portion configured to:

filter the plurality of sound pressure signals to at least one of control a region or correct characteristics of the plurality of speaker units; and supply the filtered plurality of sound pressure signals to the plurality of speaker units respectively, wherein the speaker array is configured to reproduce a sound field inside a closed curved surface based on a wave field synthesis, wherein the plurality of speaker units of the speaker array are arranged along and on an edge of a circular end portion which is opposite to an abutting side of a listener's ear pad, and the plurality of speaker units are inclined inwardly towards the closed curved surface, wherein the closed curved surface is a region around the listener's auricle, and wherein the closed curved surface is located between a body of the sound pressure signal supplying device and the listener's auricle.

15. The sound pressure signal supplying device according to claim 14, wherein the sound pressure signal supply portion is further configured to filter the plurality of sound pressure signals so that a sound emitted from each of the speaker units of the plurality of speaker units is allowed to be a sound of a position in an inner side from the position of each of the speaker units of the plurality of speaker units.

16. A method, comprising:

in a mounting type device to be mounted on a listener's head, the mounting type device comprising a speaker array, wherein the speaker array comprises a plurality of speaker units circularly arranged to surround a listener's auricle:

obtaining a sound pressure signal corresponding to each of the plurality of speaker units, filtering the obtained sound pressure signal corresponding to each of the plurality of speaker units to at least one of control a region or correct characteristics of the plurality of speaker units; and supplying the filtered sound pressure signal corresponding to each of to the plurality of speaker units respectively, wherein the speaker array is configured to reproduce a sound field inside a closed curved surface based on a wave field synthesis, wherein the plurality of speaker units of the speaker array are arranged along and on an edge of a circular end portion which is opposite to an abutting side of a listener's ear pad and the plurality of speaker units are inclined inwardly towards the closed curved surface, and wherein the closed curved surface is a region around the listener's auricle, and wherein the closed curved surface is located between a body of the mounting type device and the listener's auricle.

17. A sound system, comprising:

a speaker array comprising a plurality of speaker units to be mounted on a listener's head and circularly arranged to surround a listener's auricle, wherein the speaker array is configured to reproduce a sound field inside a closed curved surface based on a wave field synthesis, wherein the plurality of speaker units of the speaker array are arranged along and on an edge of a circular end portion which is opposite to an abutting side of a listener's ear pad and the plurality of speaker units are inclined inwardly towards the closed curved surface, and wherein the closed curved surface, is a region around the listener's auricle, located between a body of the sound system and the listener's auricle;

a sound pressure signal obtaining portion configured to obtain sound pressure signals corresponding to the plurality of speaker units; and a sound pressure signal supply portion configured to: filter the obtained sound pressure signals to at least one of control a region or correct characteristics of the plurality of speaker units; and supply the filtered sound pressure signals to the plurality of speaker units, respectively.

* * * * *